US008475205B2

(12) United States Patent
Ehret et al.

(10) Patent No.: US 8,475,205 B2
(45) **Date of Patent: *Jul. 2, 2013**

(54) CONTINUITY MAINTAINING BIASING MEMBER

(71) Applicant: PPC Broadband, Inc., East Syracuse, NY (US)

(72) Inventors: Trevor Ehret, North Haven, CT (US); Richard A. Haube, Cazenovia, NY (US); Noah Montena, Syracuse, NY (US); Souheil Zraik, Liverpool, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/726,349

(22) Filed: Dec. 24, 2012

(65) Prior Publication Data

US 2013/0115812 A1 May 9, 2013

Related U.S. Application Data

(63) Continuation of application No. 13/075,406, filed on Mar. 30, 2011, now Pat. No. 8,366,481.

(51) Int. Cl.
*H01R 9/05* (2006.01)

(52) U.S. Cl.
USPC ..... 439/578

(58) Field of Classification Search
USPC ..... 439/578–584
See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |

(Continued)

FOREIGN PATENT DOCUMENTS

| | | | |
|---|---|---|---|
| CA | 2096710 | A1 | 11/1994 |
| CN | 201149936 | Y | 11/2008 |

(Continued)

OTHER PUBLICATIONS

Digicon AVL Connector. ARRIS Group Inc. [online]. 3 pages. [retrieved on Apr. 22, 2010]. Retrieved from the Internet< URL: http://www.arrisi.com/special/digiconAVL.asp>.

(Continued)

*Primary Examiner* — Briggitte R Hamond
(74) *Attorney, Agent, or Firm* — Schmeiser, Olsen & Watts LLP

(57) ABSTRACT

A post having a first end, a second end, and a flange proximate the second end, wherein the post is configured to receive a center conductor surrounded by a dielectric of a coaxial cable, a connector body attached to the post, a coupling element attached to the post, the coupling element having a first end a second end, and a biasing member disposed within a cavity formed between the first end of the coupling element and the connector body to bias the coupling element against the post is provided. Moreover, a connector body having a biasing element, wherein the biasing element biases the coupling element against the post, is further provided. Furthermore, associated methods are also provided.

50 Claims, 9 Drawing Sheets

U.S. PATENT DOCUMENTS

| | | | |
|---|---|---|---|
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |
| 4,525,017 | A | 6/1985 | Schildkraut et al. |

4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth 5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,769,926 B1 8/2004 Montena
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 8/2005 Holland
6,939,169 B2 9/2005 Islam et al.
6,971,912 B2 12/2005 Montena et al.
7,029,326 B2 4/2006 Montena
7,070,447 B1 7/2006 Montena
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,229,303 B2 6/2007 Vermoesen et al.
7,252,546 B1 8/2007 Holland
7,255,598 B2 8/2007 Montena et al.
7,299,550 B2 11/2007 Montena
7,375,533 B2 5/2008 Gale
7,393,245 B2 7/2008 Palinkas et al.
7,404,737 B1 7/2008 Youtsey
7,452,239 B2 11/2008 Montena
7,455,550 B1 11/2008 Sykes
7,462,068 B2 12/2008 Amidon
7,476,127 B1 1/2009 Wei
7,479,035 B2 1/2009 Bence et al.
7,488,210 B1 2/2009 Burris et al.
7,494,355 B2 2/2009 Hughes et al.

| | | | |
|---|---|---|---|
| 7,497,729 | B1 | 3/2009 | Wei |
| 7,507,117 | B2 | 3/2009 | Amidon |
| 7,544,094 | B1 | 6/2009 | Paglia et al. |
| 7,566,236 | B2 | 7/2009 | Malloy et al. |
| 7,607,942 | B1 | 10/2009 | Van Swearingen |
| 7,674,132 | B1 | 3/2010 | Chen |
| 7,682,177 | B2 | 3/2010 | Berthet |
| 7,727,011 | B2 | 6/2010 | Montena et al. |
| 7,753,705 | B2 | 7/2010 | Montena |
| 7,753,727 | B1 | 7/2010 | Islam et al. |
| 7,794,275 | B2 | 9/2010 | Rodrigues |
| 7,806,714 | B2 | 10/2010 | Williams et al. |
| 7,806,725 | B1 | 10/2010 | Chen |
| 7,811,133 | B2 | 10/2010 | Gray |
| 7,824,216 | B2 | 11/2010 | Purdy |
| 7,828,595 | B2 | 11/2010 | Mathews |
| 7,830,154 | B2 | 11/2010 | Gale |
| 7,833,053 | B2 | 11/2010 | Mathews |
| 7,845,976 | B2 | 12/2010 | Mathews |
| 7,845,978 | B1 | 12/2010 | Chen |
| 7,850,487 | B1 | 12/2010 | Wei |
| 7,857,661 | B1 | 12/2010 | Islam |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,927,135 | B1 | 4/2011 | Wlos |
| 7,950,958 | B2 | 5/2011 | Mathews |
| 7,955,126 | B2 | 6/2011 | Bence et al. |
| 7,972,158 | B2 | 7/2011 | Wild et al. |
| 8,029,315 | B2 | 10/2011 | Purdy et al. |
| 8,062,044 | B2 | 11/2011 | Montena et al. |
| 8,075,338 | B1 | 12/2011 | Montena |
| 8,079,860 | B1 | 12/2011 | Zraik |
| 8,152,551 | B2 | 4/2012 | Zraik |
| 8,157,588 | B1 | 4/2012 | Rodrigues et al. |
| 8,167,635 | B1 | 5/2012 | Mathews |
| 8,167,636 | B1 | 5/2012 | Montena |
| 8,167,646 | B1 | 5/2012 | Mathews |
| 8,172,612 | B2 | 5/2012 | Bence et al. |
| 8,192,237 | B2 | 6/2012 | Purdy et al. |
| 2002/0013088 | A1 | 1/2002 | Rodrigues et al. |
| 2002/0038720 | A1 | 4/2002 | Kai et al. |
| 2003/0214370 | A1 | 11/2003 | Allison et al. |
| 2003/0224657 | A1 | 12/2003 | Malloy |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2005/0233636 | A1 | 10/2005 | Rodrigues et al. |
| 2006/0099853 | A1 | 5/2006 | Sattele et al. |
| 2006/0110977 | A1 | 5/2006 | Matthews |
| 2006/0154519 | A1 | 7/2006 | Montena |
| 2007/0026734 | A1 | 2/2007 | Bence et al. |
| 2007/0049113 | A1 | 3/2007 | Rodrigues et al. |
| 2007/0123101 | A1 | 5/2007 | Palinkas |
| 2007/0155232 | A1 | 7/2007 | Burris et al. |
| 2007/0175027 | A1 | 8/2007 | Khemakhem et al. |
| 2007/0243759 | A1 | 10/2007 | Rodrigues et al. |
| 2007/0243762 | A1 | 10/2007 | Burke et al. |
| 2008/0102696 | A1 | 5/2008 | Montena |
| 2008/0289470 | A1 | 11/2008 | Aston |
| 2009/0029590 | A1 | 1/2009 | Sykes et al. |
| 2009/0098770 | A1 | 4/2009 | Bence et al. |
| 2010/0055978 | A1 | 3/2010 | Montena |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0233901 | A1 | 9/2010 | Wild et al. |
| 2010/0233902 | A1 | 9/2010 | Youtsey |
| 2010/0255720 | A1 | 10/2010 | Radzik et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy |
| 2011/0021072 | A1 | 1/2011 | Purdy |
| 2011/0027039 | A1 | 2/2011 | Blair |
| 2011/0053413 | A1 | 3/2011 | Mathews |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |
| 2012/0021642 | A1 | 1/2012 | Zraik |
| 2012/0094532 | A1 | 4/2012 | Montena |
| 2012/0122329 | A1 | 5/2012 | Montena et al. |
| 2012/0145454 | A1 | 6/2012 | Montena |
| 2012/0196476 | A1 | 8/2012 | Haberek et al. |
| 2012/0202378 | A1 | 8/2012 | Krenceski et al. |
| 2012/0214342 | A1 | 8/2012 | Mathews |
| 2012/0252263 | A1 | 10/2012 | Ehret et al. |

FOREIGN PATENT DOCUMENTS

| | | | |
|---|---|---|---|
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| DE | 4439852 | A1 | 5/1996 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | | 6/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 4503793 | B9 | 1/2002 |
| JP | 2002075556 | A | 3/2002 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | 2011128665 | A1 | 10/2011 |
| WO | 2011128666 | A1 | 10/2011 |
| WO | 2012061379 | A2 | 5/2012 |

OTHER PUBLICATIONS

U.S. Appl. No. 13/726,347, filed Dec. 24, 2012.

U.S. Appl. No. 13/726,330, filed Dec. 24, 2012.

U.S. Appl. No. 13/726,339, filed Dec. 24, 2012.

U.S. Appl. No. 13/726,356, filed Dec. 24, 2012.

Office Action (Mail Date Mar. 6, 2013) for U.S. Appl. No. 13/726,330, filed Dec. 24, 2012.

Office Action (Mail Date Feb. 20, 2013) for U.S. Appl. No. 13/726,339, filed Dec. 24, 2012.
Office Action (Mail Date Feb. 20, 2013) for U.S. Appl. No. 13/726,356, filed Dec. 24, 2012.
Office Action (Mail Date Mar. 11, 2013) for U.S. Appl. No. 13/726,347, filed Dec. 24, 2012.
U.S. Appl. No. 13/758,586, filed Feb. 4, 2013.

CONTINUITY MAINTAINING BIASING MEMBER

CROSS-REFERENCE TO RELATED APPLICATION

This continuation application claims the priority benefit of United States Non-Provisional patent application Ser. No. 13/075,406 filed Mar. 30, 2011, and entitled CONTINUITY MAINTAINING BIASING MEMBER

FIELD OF TECHNOLOGY

The following relates to connectors used in coaxial cable communication applications, and more specifically to embodiments of a connector having a biasing member for maintaining continuity through a connector.

BACKGROUND

Connectors for coaxial cables are typically connected onto complementary interface ports to electrically integrate coaxial cables to various electronic devices. Maintaining continuity through a coaxial cable connector typically involves the continuous contact of conductive connector components which can prevent radio frequency (RF) leakage and ensure a stable ground connection. In some instances, the coaxial cable connectors are present outdoors, exposed to weather and other numerous environmental elements. Weathering and various environmental elements can work to create interference problems when metallic conductive connector components corrode, rust, deteriorate or become galvanically incompatible, thereby resulting in intermittent contact, poor electromagnetic shielding, and degradation of the signal quality. Moreover, some metallic connector components can permanently deform under the torque requirements of the connector mating with an interface port. The permanent deformation of a metallic connector component results in intermittent contact between the conductive components of the connector and a loss of continuity through the connector.

Thus, a need exists for an apparatus and method for ensuring continuous contact between conductive components of a connector.

SUMMARY

A first general aspect relates to a coaxial cable connector comprising a post having a first end, a second end, and a flange proximate the second end, wherein the post is configured to receive a center conductor surrounded by a dielectric of a coaxial cable, a connector body attached to the post, a coupling element attached to the post, the coupling element having a first end and a second end, and a biasing member disposed within a cavity formed between the first end of the coupling element and the connector body to bias the coupling element against the post.

A second general aspect relates to a coaxial cable connector comprising a post having a first end, a second end, and a flange proximate the second end, wherein the post is configured to receive a center conductor surrounded by a dielectric of a coaxial cable, a coupling element attached to the post, the coupling element having a first end and a second end, and a connector body having a biasing element, wherein the biasing element biases the coupling element against the post.

A third general aspect relates to a coaxial cable connector comprising a post having a first end, a second end, and a flange proximate the second end, wherein the post is configured to receive a center conductor surrounded by a dielectric of a coaxial cable, a connector body attached to the post, a coupling element attached to the post, the coupling element having a first end and a second end, and a means for biasing the coupling element against the post, wherein the means does not hinder rotational movement of the coupling element.

A fourth general aspect relates to a method of facilitating continuity through a coaxial cable connector, comprising providing a post having a first end, a second end, and a flange proximate the second end, wherein the post is configured to receive a center conductor surrounded by a dielectric of a coaxial cable, a connector body attached to the post, and a coupling element attached to the post, the coupling element having a first end and a second end, and disposing a biasing member within a cavity formed between the first end of the coupling element and the connector body to bias the coupling element against the post.

A fifth general aspect relates to a method of facilitating continuity through a coaxial cable connector, comprising providing a post having a first end, a second end, and a flange proximate the second end, wherein the post is configured to receive a center conductor surrounded by a dielectric of a coaxial cable, a coupling element attached to the post, the coupling element having a first end and a second end, and a connector body having a first end, a second end, and an annular recess proximate the second end of the connector body, extending the annular recess a radial distance to engage the coupling element, wherein the engagement between the extended annular recess and the coupling element biases the coupling element against the post.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1A:
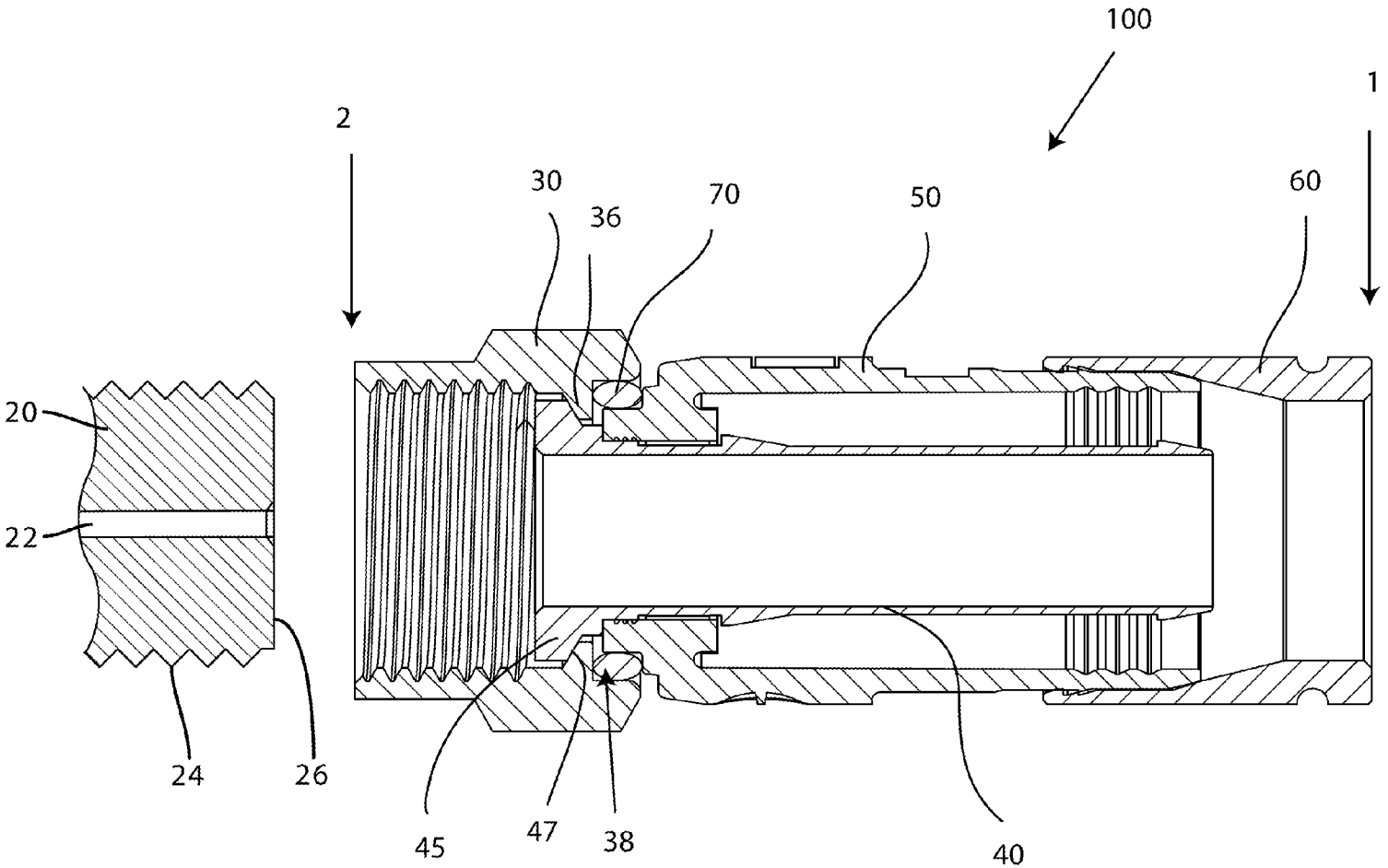
FIG. 1A depicts a cross-sectional view of a first embodiment of a coaxial cable connector.
Figure 1B:
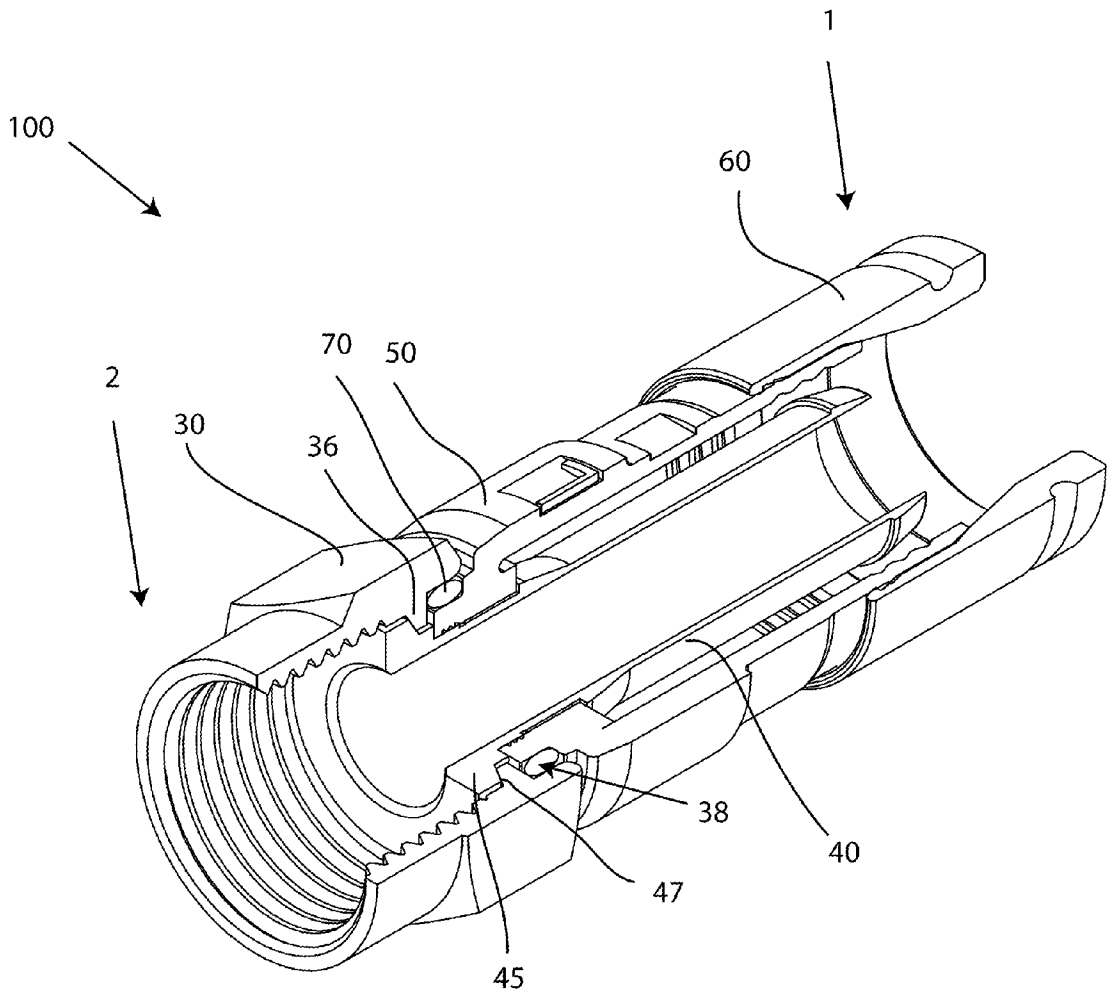
FIG. 1B depicts a perspective cut-away view of the first embodiment of a coaxial cable connector.

Referring to the drawings, FIG. 1 depicts an embodiment of a coaxial cable connector 100. A coaxial cable connector embodiment 100 has a first end 1 and a second end 2, and can be provided to a user in a preassembled configuration to ease handling and installation during use. Coaxial cable connector 100 may be an F connector, or similar coaxial cable connector. Furthermore, the connector 100 includes a post 40 configured for receiving a prepared portion of a coaxial cable 10.

Figure 2:
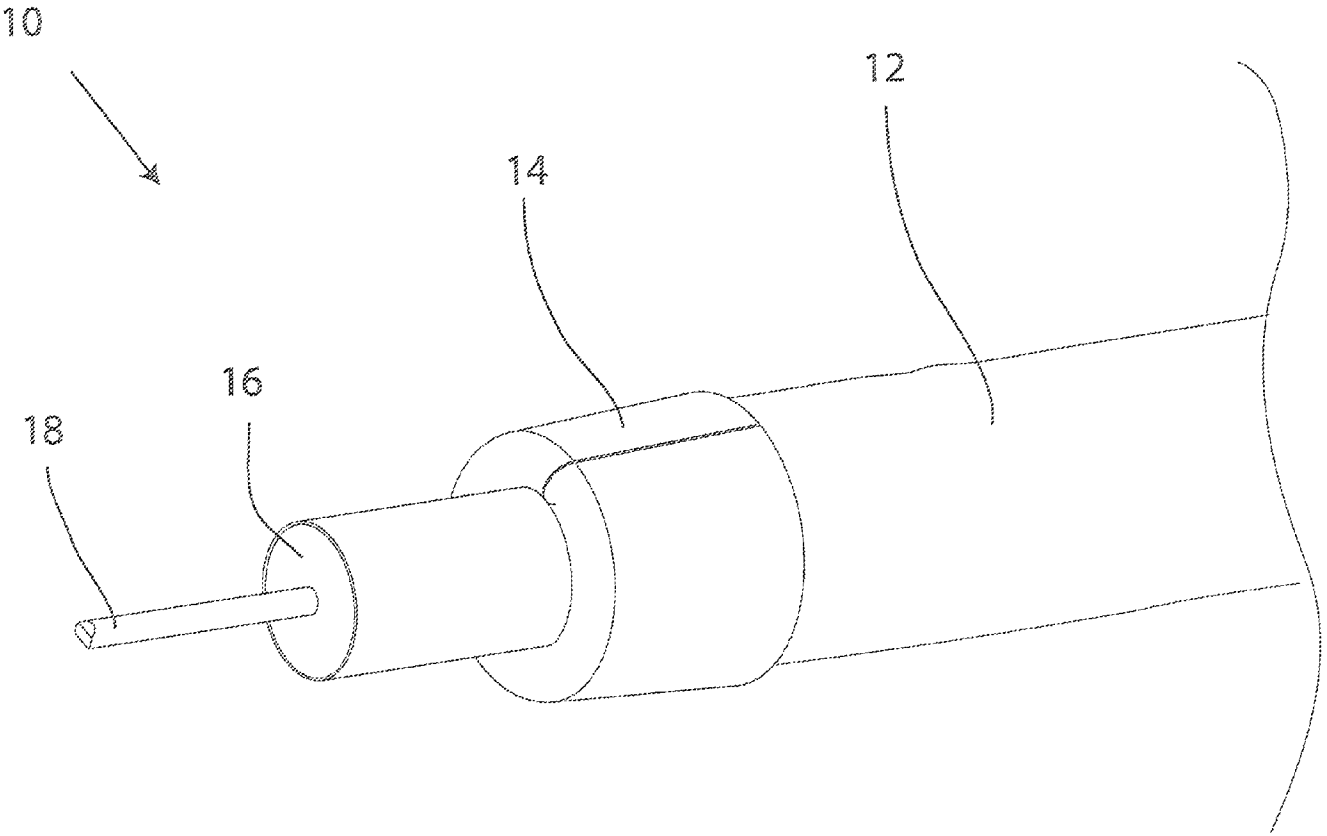
FIG. 2 depicts a perspective view of an embodiment of a coaxial cable.

Referring now to FIG. 2, the coaxial cable connector 100 may be operably affixed to a prepared end of a coaxial cable 10 so that the cable 10 is securely attached to the connector 100. The coaxial cable 10 may include a center conductive strand 18, surrounded by an interior dielectric 16; the interior dielectric 16 may possibly be surrounded by a conductive foil layer; the interior dielectric 16 (and the possible conductive foil layer) is surrounded by a conductive strand layer 14; the conductive strand layer 14 is surrounded by a protective outer jacket 12*a*, wherein the protective outer jacket 12 has dielectric properties and serves as an insulator. The conductive strand layer 14 may extend a grounding path providing an electromagnetic shield about the center conductive strand 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and center conductive strand 18. The protective outer jacket 12 can physically protect the various components of the coaxial cable 10 from damage which may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. However, when the protective outer jacket 12 is exposed to the environment, rain and other environmental pollutants may travel down the protective outer jack 12. The conductive strand layer 14 can be comprised of conductive materials suitable for carrying electromagnetic signals and/or providing an electrical ground connection or electrical path connection. The conductive strand layer 14 may also be a conductive layer, braided layer, and the like. Various embodiments of the conductive strand layer 14 may be employed to screen unwanted noise. For instance, the conductive strand layer 14 may comprise a metal foil (in addition to the possible conductive foil) wrapped around the dielectric 16 and/or several conductive strands formed in a continuous braid around the dielectric 16. Combinations of foil and/or braided strands may be utilized wherein the conductive strand layer 14 may comprise a foil layer, then a braided layer, and then a foil layer. Those in the art will appreciate that various layer combinations may be implemented in order for the conductive strand layer 14 to effectuate an electromagnetic buffer helping to prevent ingress of environmental noise or unwanted noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Furthermore, environmental elements that contact conductive components, including metallic components, of a coaxial connector may be important to the longevity and efficiency of the coaxial cable connector (i.e. preventing RF leakage and ensuring stable continuity through the connector 100). Environmental elements may include any environmental pollutant, any contaminant, chemical compound, rainwater, moisture, condensation, stormwater, polychlorinated biphenyl's (PCBs), contaminated soil from runoff, pesticides, herbicides, and the like. Environmental elements, such as water or moisture, may corrode, rust, degrade, etc. connector components exposed to the environmental elements. Thus, metallic conductive O-rings utilized by a coaxial cable connector that may be disposed in a position of exposure to environmental elements may be insufficient over time due to the corrosion, rusting, and overall degradation of the metallic O-ring.

Referring back to FIG. 1, the connector 100 may mate with a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. However, various embodiments may employ a smooth surface, as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and depth of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a coaxial cable connector, such as connector 100. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

Referring further to FIG. 1, embodiments of a connector 100 may include a post 40, a coupling element 30, a connector body 50, a fastener member 60, and a biasing member 70. Embodiments of connector 100 may also include a post 40 having a first end 41, a second end 42, and a flange 45 proximate the second end 42, wherein the post 40 is configured to receive a center conductor 18 surrounded by a dielectric 16 of a coaxial cable 10, a connector body 50 attached to the post 40, a coupling element 30 attached to the post 40, the coupling element 30 having a first end 31 and a second end 32, and a biasing member 70 disposed within a cavity 38 formed between the first end 31 of the coupling element 30 and the connector body 50 to bias the coupling element 30 against the post 40.

Figure 3:
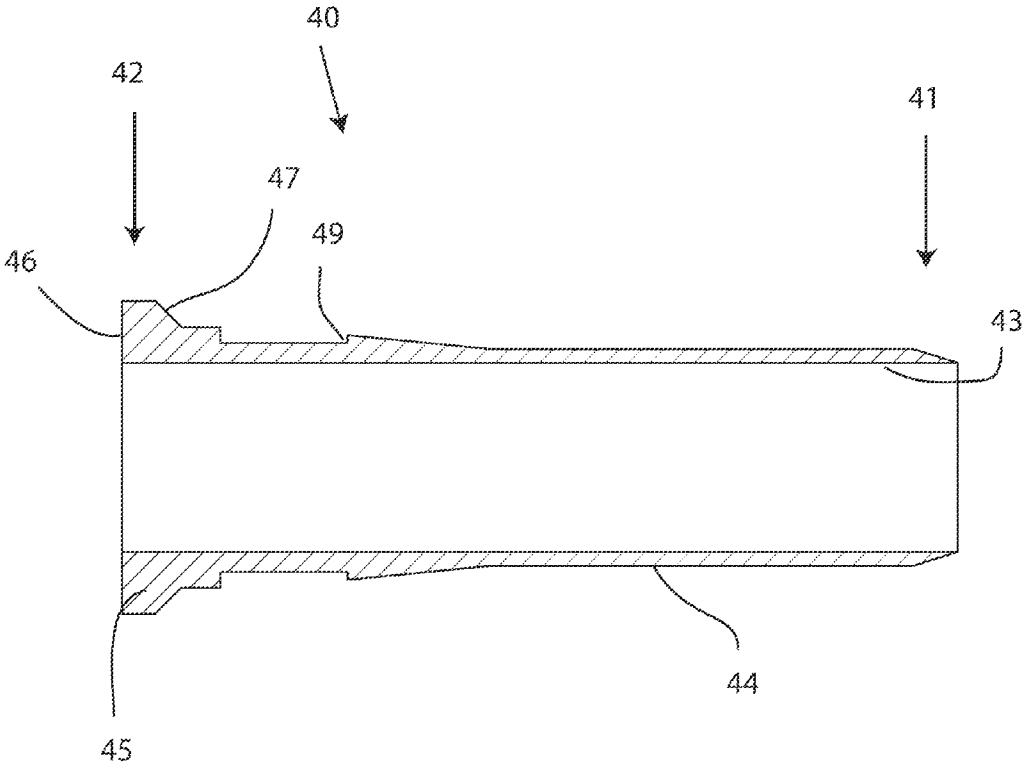
FIG. 3 depicts a cross-sectional view of an embodiment of a post.

Embodiments of connector 100 may include a post 40, as further shown in FIG. 3. The post 40 comprises a first end 41, a second end 42, an inner surface 43, and an outer surface 44. Furthermore, the post 40 may include a flange 45, such as an externally extending annular protrusion, located proximate or otherwise near the second end 42 of the post 40. The flange 45 may include an outer tapered surface 47 facing the first end 41 of the post 40 (i.e. tapers inward toward the first end 41 from a larger outer diameter proximate or otherwise near the second end 42 to a smaller outer diameter. The outer tapered surface 47 of the flange 45 may correspond to a tapered surface of the lip 36 of the coupling element 30. Further still, an embodiment of the post 40 may include a surface feature 49 such as a lip or protrusion that may engage a portion of a connector body 50 to secure axial movement of the post 40 relative to the connector body 50. However, the post may not include such a surface feature 49, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge 26 of an interface port 20. The post 40 should be formed such that portions of a prepared coaxial cable 10 including the dielectric 16 and center conductor 18 can pass axially into the first end 41 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield or strand 14. Accordingly, where an embodiment of the post 40 may be inserted into an end of the prepared coaxial cable 10 under the drawn back conductive strand 14, substantial physical and/or electrical contact with the strand layer 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

Figure 4:
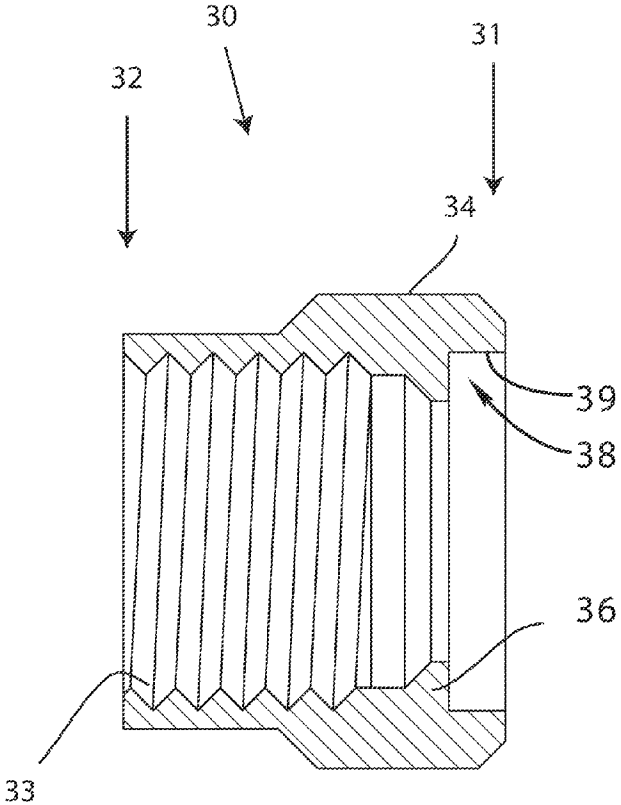
FIG. 4 depicts a cross-sectional view of an embodiment of a coupling element.

With continued reference to FIG. 1, and further reference to FIG. 4, embodiments of connector 100 may include a coupling element 30. The coupling element 30 may be a nut, a threaded nut, port coupling element, rotatable port coupling element, and the like. The coupling element 30 may include a first end 31, second end 32, an inner surface 33, and an outer surface 34. The inner surface 33 of the coupling element 30 may be a threaded configuration, the threads having a pitch and depth corresponding to a threaded port, such as interface port 20. In other embodiments, the inner surface 33 of the coupling element 30 may not include threads, and may be axially inserted over an interface port, such as port 20. The coupling element 30 may be rotatably secured to the post 40 to allow for rotational movement about the post 40. The coupling element 30 may comprise an internal lip 36 located proximate the first end 31 and configured to hinder axial movement of the post 40. Furthermore, the coupling element 30 may comprise a cavity 38 extending axially from the edge of first end 31 and partial defined and bounded by the internal lip 36. The cavity 38 may also be partially defined and bounded by an outer internal wall 39. The coupling element 30 may be formed of conductive materials facilitating grounding through the coupling element 30, or threaded nut. Accordingly the coupling element 30 may be configured to extend an electromagnetic buffer by electrically contacting conductive surfaces of an interface port 20 when a coaxial cable connector, such as connector 100, is advanced onto the port 20. In addition, the coupling element 30 may be formed of non-conductive material and function only to physically secure and advance a connector 100 onto an interface port 20. Moreover, the coupling element 30 may be formed of both conductive and non-conductive materials. For example the internal lip 36 may be formed of a polymer, while the remainder of the coupling element 30 may be comprised of a metal or other conductive material. In addition, the coupling element 30 may be formed of metals or polymers or other materials that would facilitate a rigidly formed body. Manufacture of the coupling element 30 may include casting, extruding, cutting, turning, tapping, drilling, injection molding, blow molding, or other fabrication methods that may provide efficient production of the component. Those in the art should appreciate the various of embodiments of the nut 30 may also comprise a coupler member, or coupling element, having no threads, but being dimensioned for operable connection to a corresponding interface port, such as interface port 20.

Figure 5:
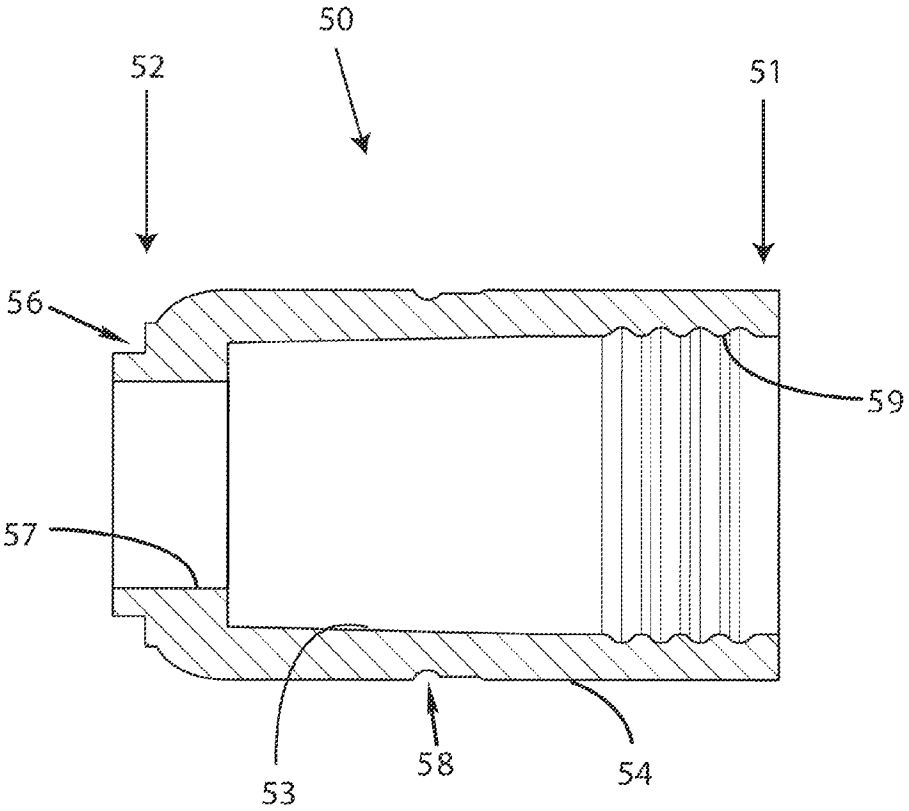
FIG. 5 depicts a cross-sectional view of a first embodiment of a connector body.

Referring still to FIG. 1, and additionally to FIG. 5, embodiments of a coaxial cable connector, such as connector 100, may include a connector body 50. The connector body 50 may include a first end 51, a second end 52, an inner surface 53, and an outer surface 54. Moreover, the connector body may include a post mounting portion 57 proximate or otherwise near the second end 52 of the body 50; the post mounting portion 57 configured to securely locate the body 50 relative to a portion of the outer surface 44 of post 40, so that the connector body 50 is axially secured with respect to the post 40, in a manner that prevents the two components from moving with respect to each other in a direction parallel to the axis of the connector 100. In addition, the connector body 50 may include an outer annular recess 56 located proximate or near the second end 52 of the connector body 50. Furthermore, the connector body 50 may include a semi-rigid, yet compliant outer surface 54, wherein the outer surface 54 may be configured to form an annular seal when the first end 51 is deformably compressed against a received coaxial cable 10 by operation of a fastener member 60. The connector body 50 may include an external annular detent 58 located along the outer surface 54 of the connector body 50. Further still, the connector body 50 may include internal surface features 59, such as annular serrations formed near or proximate the internal surface of the first end 51 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

Figure 6:
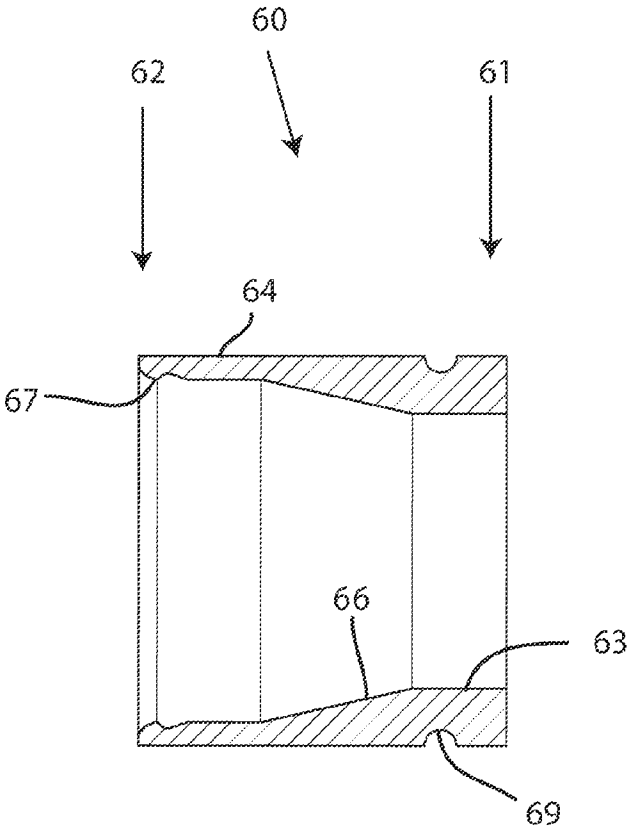
FIG. 6 depicts a cross-sectional view of an embodiment of a fastener member.

With further reference to FIG. 1 and FIG. 6, embodiments of a coaxial cable connector 100 may include a fastener member 60. The fastener member 60 may have a first end 61, second end 62, inner surface 63, and outer surface 64. In addition, the fastener member 60 may include an internal annular protrusion 67 located proximate the second end 62 of the fastener member 60 and configured to mate and achieve purchase with the annular detent 58 on the outer surface 54 of connector body 50. Moreover, the fastener member 60 may comprise a central passageway or generally axial opening defined between the first end 61 and second end 62 and extending axially through the fastener member 60. The central passageway may include a ramped surface 66 which may be positioned between a first opening or inner bore having a first inner diameter positioned proximate or otherwise near the first end 61 of the fastener member 60 and a second opening or inner bore having a larger, second inner diameter positioned proximate or otherwise near the second end 62 of the fastener member 60. The ramped surface 66 may act to deformably compress the outer surface 54 of the connector body 50 when the fastener member 60 is operated to secure a coaxial cable 10. For example, the narrowing geometry will compress squeeze against the cable, when the fastener member 60 is compressed into a tight and secured position on the connector body 50. Additionally, the fastener member 60 may comprise an exterior surface feature 69 positioned proximate with or close to the first end 61 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The second end 62 of the fastener member 60 may extend an axial distance so that, when the fastener member 60 is compressed into sealing position on the coaxial cable 100, the fastener member 60 touches or resides substantially proximate significantly close to the coupling element 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

Referring back to FIG. 1, embodiments of a coaxial cable connector 100 can include a biasing member 70. The biasing member 70 may be formed of a non-metallic material to avoid rust, corrosion, deterioration, and the like, caused by environmental elements, such as water. Additional materials the biasing member 70 may be formed of may include, but are not limited to, polymers, plastics, elastomers, elastomeric mixtures, composite materials, rubber, and/or the like and/or any operable combination thereof. The biasing member 70 may be a resilient, rigid, semi-rigid, flexible, or elastic member, component, element, and the like. The resilient nature of the biasing member 70 may help avoid permanent deformation while under the torque requirements when a connector 100 is advanced onto an interface port 20.

Moreover, the biasing member 70 may facilitate constant contact between the coupling element 30 and the post 40. For instance, the biasing member 70 may bias, provide, force, ensure, deliver, etc. the contact between the coupling element 30 and the post 40. The constant contact between the coupling element 30 and the post 40 promotes continuity through the connector 100, reduces/eliminates RF leakage, and ensures a stable ground through the connection of a connector 100 to an interface port 20 in the event the connector 100 is not fully tightened onto the port 20. To establish and maintain solid, constant contact between the coupling element 30 and the post 40, the biasing member 70 may be disposed behind the coupling element 30, proximate or otherwise near the second end 52 of the connector. In other words, the biasing member 70 may be disposed within the cavity 38 formed between the coupling element 30 and the annular recess 56 of the connector body 50. The biasing member 70 can provide a biasing force against the coupling element 30, which may axially displace the coupling element 30 into constant direct contact with the post 40. In particular, the disposition of a biasing member 70 in annular cavity 38 proximate the second end 52 of the connector body 50 may axially displace the coupling element 30 towards the post 40, wherein the lip 36 of the coupling element 30 directly contacts the outer tapered surface 47 of the flange 45 of the post 40. The location and structure of the biasing member 70 may promote continuity between the post 40 and the coupling element 30, but does not impede the rotational movement of the coupling element 30 (e.g. rotational movement about the post 40). The biasing member 70 may also create a barrier against environmental elements, thereby preventing environmental elements from entering the connector 100. Those skilled in the art would appreciate that the biasing member 70 may be fabricated by extruding, coating, molding, injecting, cutting, turning, elastomeric batch processing, vulcanizing, mixing, stamping, casting, and/or the like and/or any combination thereof in order to provide efficient production of the component.

Embodiments of biasing member 70 may include an annular or semi-annular resilient member or component configured to physically and electrically couple the post 40 and the coupling element 30. One embodiment of the biasing member 70 may be a substantially circinate torus or toroid structure, or other ring-like structure having a diameter (or cross-section area) large enough that when disposed within annular cavity 38 proximate the annular recess 56 of the connector body 50, the coupling element 30 is axially displaced against the post 40 and/or biased against the post 40. Moreover, embodiments of the biasing member 70 may be an O-ring configured to cooperate with the annular recess 56 proximate the second end 52 of connector body 50 and the outer internal wall 39 and lip 36 forming cavity 38 such that the biasing member 70 may make contact with and/or bias against the annular recess 56 (or other portions) of connector body 50 and outer internal wall 39 and lip 36 of coupling element 30. The biasing between the outer internal wall 39 and lip 36 of the coupling element 30 and the annular recess 56, and surrounding portions, of the connector body 50 can drive and/or bias the coupling element 30 in a substantially axial or axial direction towards the second end 2 of the connector 100 to make solid and constant contact with the post 40. For instance, the biasing member 70 should be sized and dimensioned large enough (e.g. oversized O-ring) such that when disposed in cavity 38, the biasing member 70 exerts enough force against both the coupling element 30 and the connector body 50 to axial displace the coupling element 30 a distance towards the post 40. Thus, the biasing member 70 may facilitate grounding of the connector 100, and attached coaxial cable 10 (shown in FIG. 2), by extending the electrical connection between the post 40 and the coupling element 30. Because the biasing member 70 may not be metallic and/or conductive, it may resist degradation, rust, corrosion, etc., to environmental elements when the connector 100 is exposed to such environmental elements. Furthermore, the resiliency of the biasing member 70 may deform under torque requirements, as opposed to permanently deforming in a manner similar to metallic or rigid components under similar torque requirements. Axial displacement of the connector body 50 may also occur, but the surface 49 of the post 40 may prevent axial displacement of the connector body 50, or friction fitting between the connector body 50 and the post 40 may prevent axial displacement of the connector body 50.

Figure 7:
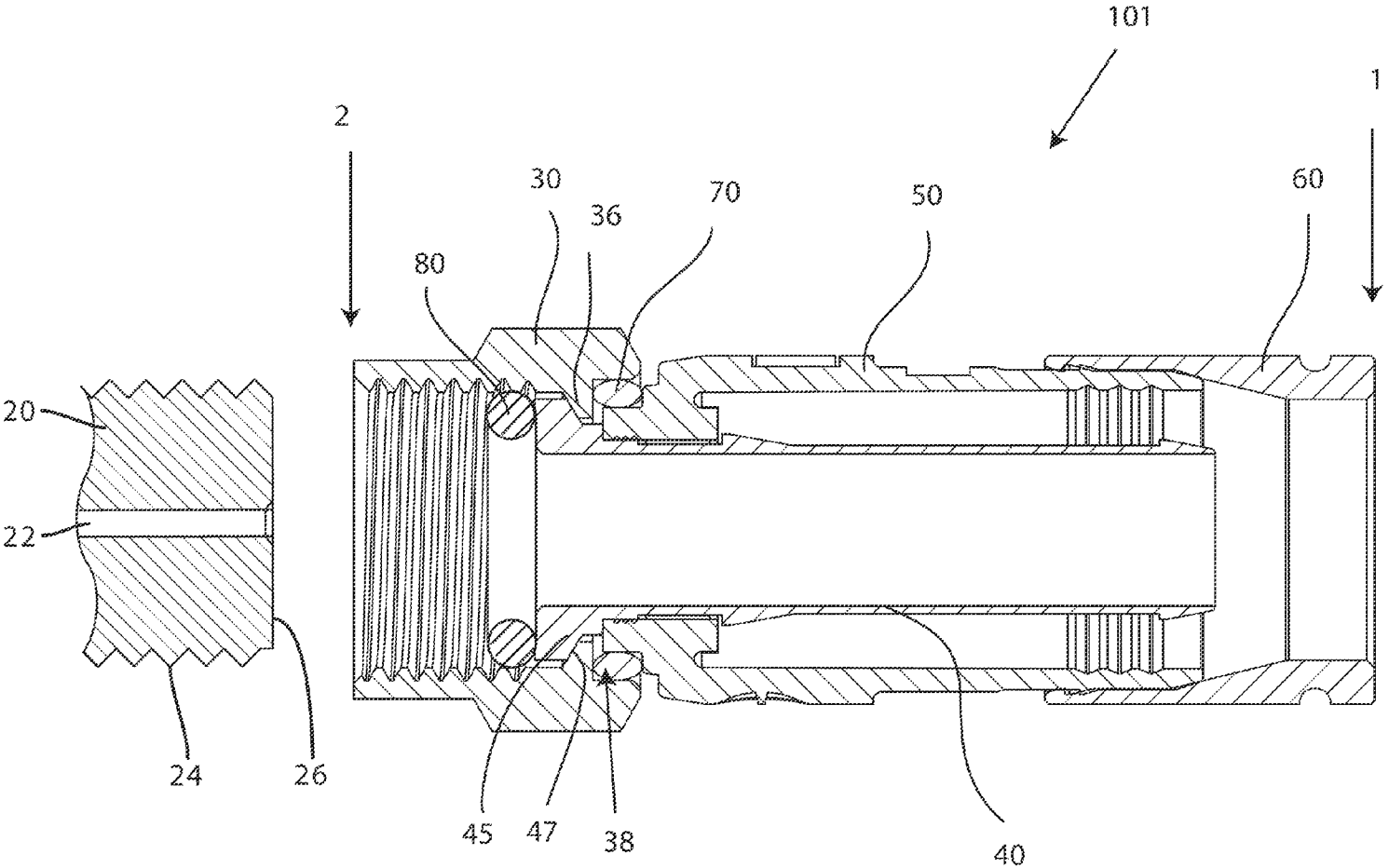
FIG. 7 depicts a cross-sectional view of a second embodiment of a coaxial cable connector.

With continued reference to the drawings, FIG. 7 depicts an embodiment of connector 101. Connector 101 may include post 40, coupling element 30, connector body 50, fastener member 60, biasing member 70, but may also include a mating edge conductive member 80 formed of a conductive material. Such materials may include, but are not limited to conductive polymers, conductive plastics, conductive elastomers, conductive elastomeric mixtures, composite materials having conductive properties, soft metals, conductive rubber, and/or the like and/or any operable combination thereof. The mating edge conductive member 80 may comprise a substantially circinate torus or toroid structure, and may be disposed within the internal portion of coupling element 30 such that the mating edge conductive member 80 may make contact with and/or reside continuous with a mating edge 46 of a post 40 when connector 101 is operably configured (e.g. assembled for communication with interface port 20). For example, one embodiment of the mating edge conductive member 80 may be an O-ring. The mating edge conductive member 80 may facilitate an annular seal between the coupling element 30 and post 40 thereby providing a physical barrier to unwanted ingress of moisture and/or other environmental contaminates. Moreover, the mating edge conductive member 80 may facilitate electrical coupling of the post 40 and coupling element 30 by extending therebetween an unbroken electrical circuit. In addition, the mating edge conductive member 80 may facilitate grounding of the connector 100, and attached coaxial cable (shown in FIG. 2), by extending the electrical connection between the post 40 and the coupling element 30. Furthermore, the mating edge conductive member 80 may effectuate a buffer preventing ingress of electromagnetic noise between the coupling element 30 and the post 40. The mating edge conductive member or O-ring 80 may be provided to users in an assembled position proximate the second end 42 of post 40, or users may themselves insert the mating edge conductive O-ring 80 into position prior to installation on an interface port 20. Those skilled in the art would appreciate that the mating edge conductive member 80 may be fabricated by extruding, coating, molding, injecting, cutting, turning, elastomeric batch processing, vulcanizing, mixing, stamping, casting, and/or the like and/or any combination thereof in order to provide efficient production of the component.

Figure 8A:
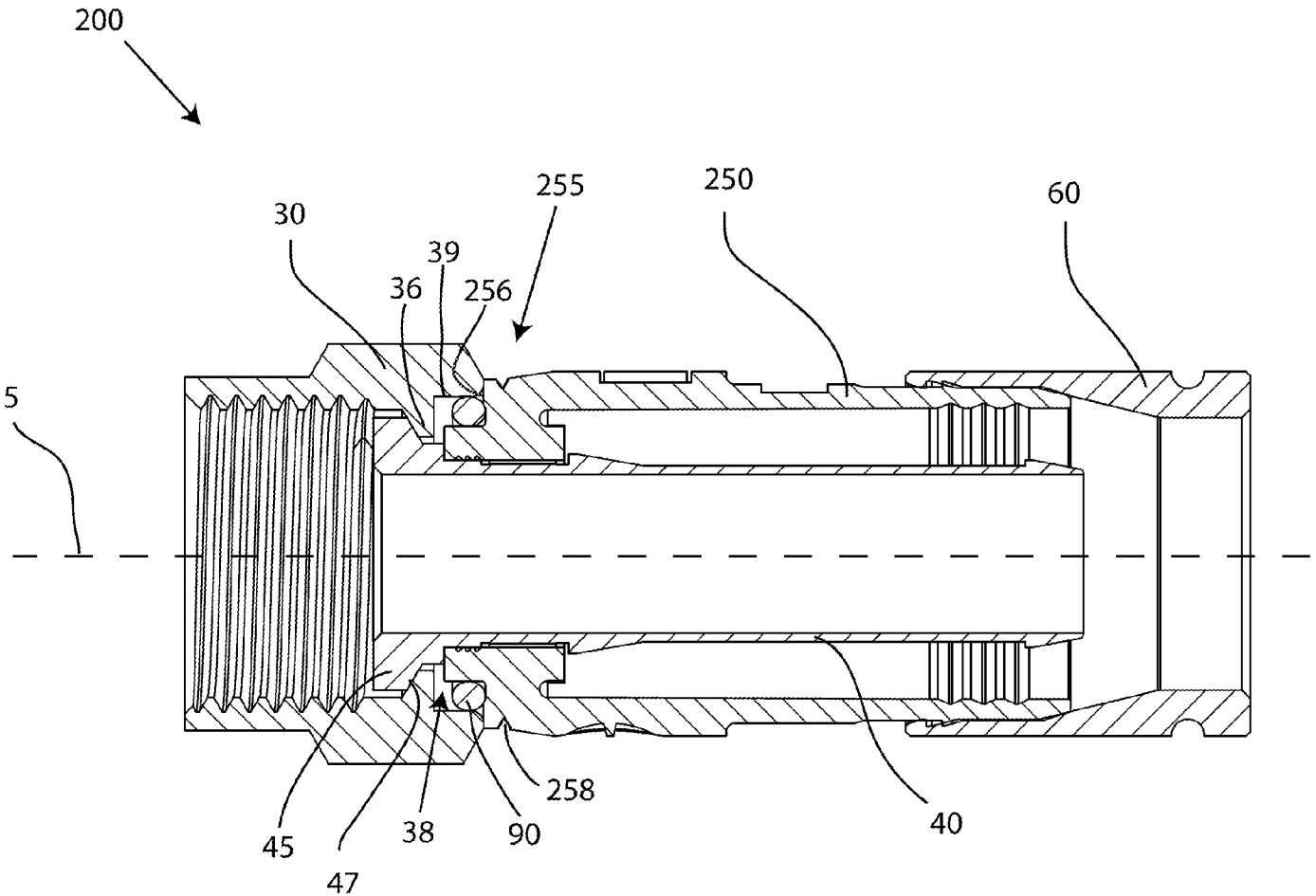
FIG. 8A depicts a cross-sectional view of a third embodiment of a coaxial cable connector.
Figure 8B:
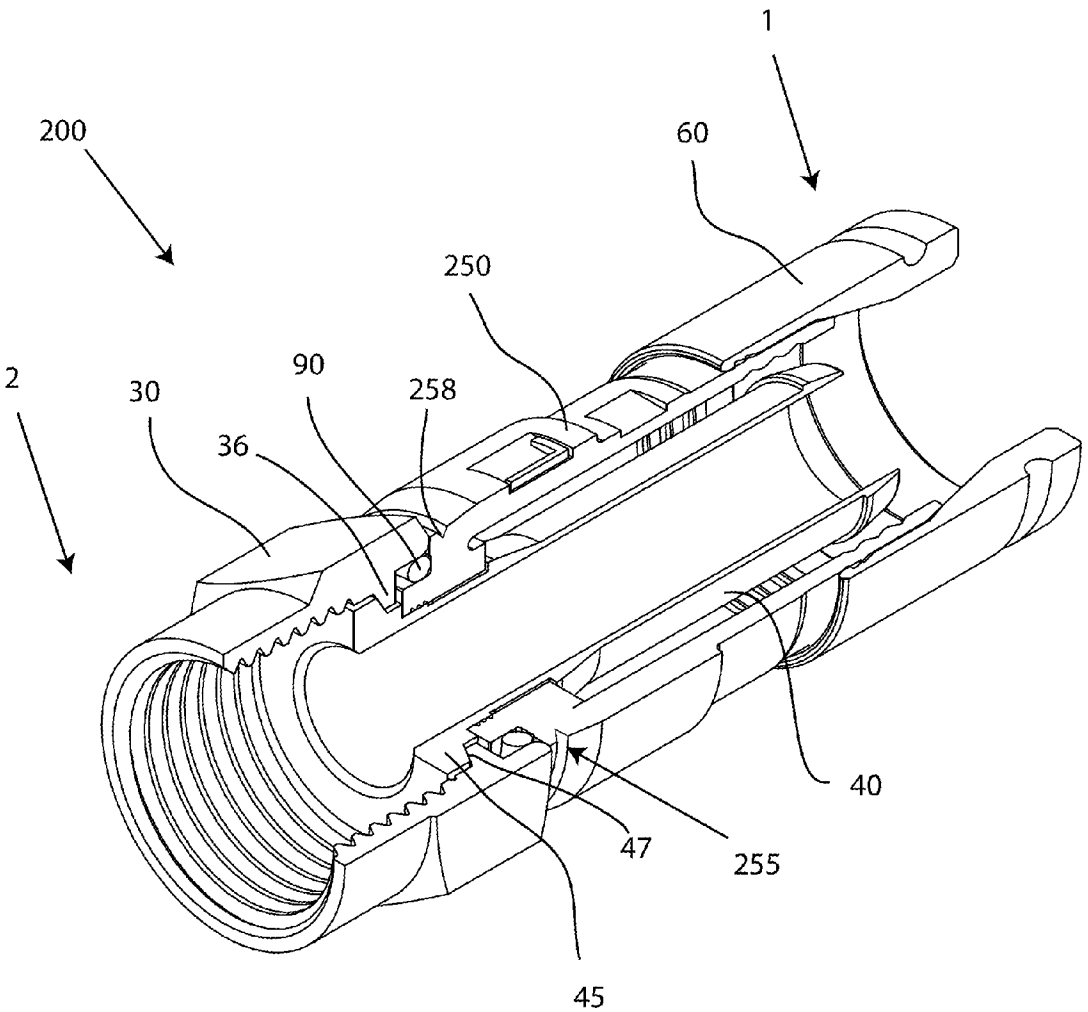
FIG. 8B depicts a perspective cut-away of the third embodiment of a coaxial cable connector.

Referring now to FIGS. 8A and 8B, an embodiment of connector 200 is described. Embodiments of connector 200 may include a post 40, a coupling element 30, a fastener member 60, a connector body 250 having biasing element 255, and a connector body member 90. Embodiments of the post 40, coupling element 30, and fastener member 60 described in association with connector 200 may share the same structural and functional aspects as described above in association with connectors 100, 101. Embodiments of connector 200 may also include a post 40 having a first end 41, a second end 42, and a flange 45 proximate the second end 42, wherein the post 40 is configured to receive a center conductor surrounded 18 by a dielectric 16 of a coaxial cable 10, a coupling element 30 attached to the post 40, the coupling element 30 having a first end 31 and a second end 32, and a connector body 250 having biasing element 255, wherein the engagement biasing element 255 biases the coupling element 30 against the post 40.

Figure 9:
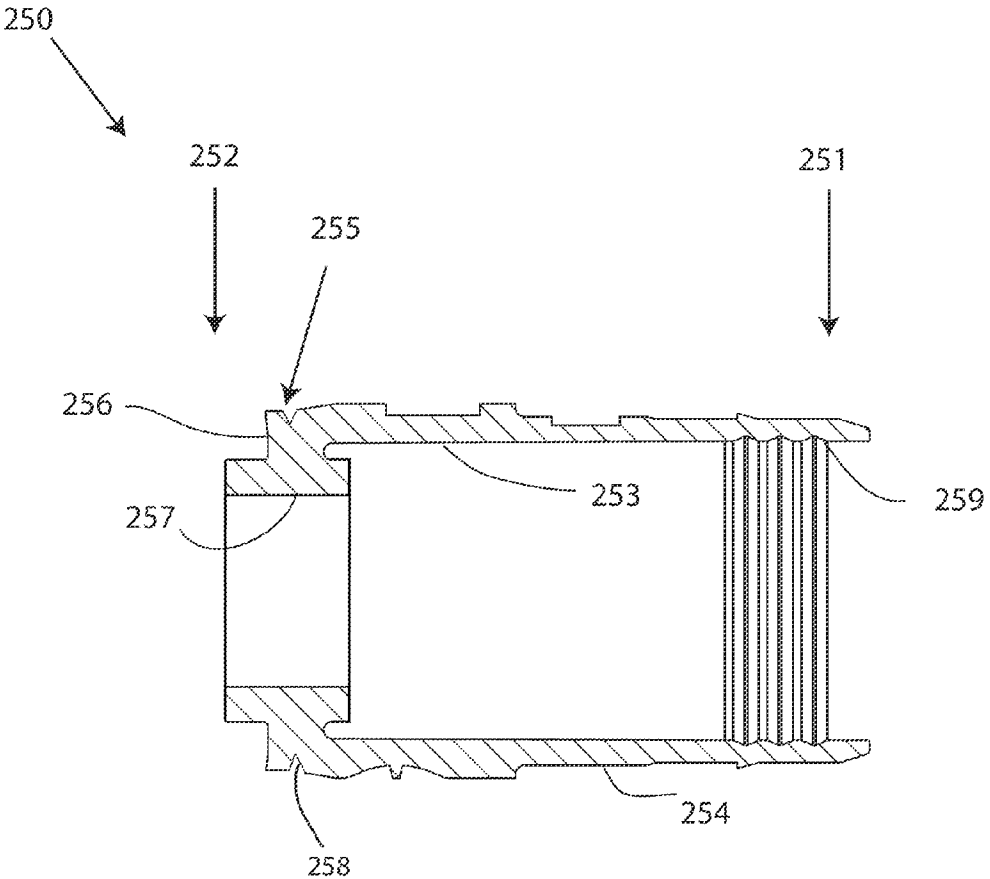
FIG. 9 depicts a cross-sectional view of a second embodiment of a connector body.

With reference now to FIG. 9, and continued reference to FIGS. 8A and 8B, embodiments of connector 200 may include a connector body 250 having a biasing element 255. The connector body 250 may include a first end 251, a second end 252, an inner surface 253, and an outer surface 254. Moreover, the connector body 250 may include a post mounting portion 257 proximate or otherwise near the second end 252 of the body 250; the post mounting portion 257 configured to securely locate the body 250 relative to a portion of the outer surface 44 of post 40, so that the connector body 250 is axially secured with respect to the post 40, in a manner that prevents the two components from moving with respect to each other in a direction parallel to the axis of the connector 200. In addition, the connector body 250 may include an extended, resilient outer annular surface 256 located proximate or near the second end 252 of the connector body 250. The extended, resilient annular surface 256 may extend a radial distance with respect to a general axis 5 of the connector 200 to facilitate biasing engagement with the coupling element 30. For instance, the extended annular surface 256 may radially extend past the internal wall 39 of the coupling element 30. In one embodiment, the extended, resilient annular surface 256 may be a resilient extension of annular recess 56 of connector body 50. In other embodiments, the extended, resilient annular surface 256, or shoulder, may function as a biasing element 255 proximate the second end 252. The biasing element 255 may be structurally integral with the connector body 250, such that the biasing element 255 is a portion of the connector body 250. In other embodiments, the biasing element 255 may be a separate component fitted or configured to be coupled with (e.g. adhered, snapped on, interference fit, and the like) an existing connector body, such as connector body 50. Moreover, the biasing element 255 of connector body 250 may be defined as a portion of the connector body 255, proximate the second end 252, that extends radially and potentially axially (slightly) from the body to bias the coupling element 30, proximate the first end 31, into contact with the post 40. The biasing element 255 may include a notch 258 to permit the necessary deflection to provide a biasing force to effectuate constant physical contact between the lip 36 of the coupling element 30 and the outer tapered surface 47 of the flange 45 of the post 40. The notch 258 may be a notch, groove, channel, or similar annular void that results in an annular portion of the connector body 50 that is removed to permit deflection in an axial direction with respect to the general axis 5 of connector 200.

Accordingly, a portion of the extended, resilient annular surface 256, or the biasing element 255, may engage the coupling element 30 to bias the coupling element 30 into contact with the post 40. Contact between the coupling element 30 and the post 40 may promote continuity through the connector 200, reduce/eliminate RF leakage, and ensure a stable ground through the connection of the connector 200 to an interface port 20 in the event the connector 200 is not fully tightened onto the port 20. In most embodiments, the extended annular surface 256 or the biasing element 255 of the connector body 250 may provide a constant biasing force behind the coupling element 30. The biasing force provided by the extended annular surface 256, or biasing element 255, behind the coupling element 30 may result in constant contact between the lip 36 of the coupling element 30 and the outward tapered surface 47 of the post 40. However, the biasing force of the extending annular surface 256, or biasing element 255, should not (significantly) hinder or prevent the rotational movement of the coupling element 30 (i.e. rotation of the coupling element 30 about the post 40). Because connector 200 may include connector body 250 having an extended, resilient annular surface 256 to improve continuity, there may be no need for an additional component such as a metallic conductive continuity member that is subject to corrosion and permanent deformation during operable advancement and disengagement with an interface port 20, which may ultimately adversely affect the signal quality (e.g. corrosion or deformation of conductive member may degrade the signal quality)

Furthermore, the connector body 250 may include a semi-rigid, yet compliant outer surface 254, wherein the outer surface 254 may be configured to form an annular seal when the first end 251 is deformably compressed against a received coaxial cable 10 by operation of a fastener member 60. Further still, the connector body 250 may include internal surface features 259, such as annular serrations formed near or proximate the internal surface of the first end 251 of the connector body 250 and configured to enhance frictional restraint and gripping of an inserted and received coaxial cable 10, through tooth-like interaction with the cable. The connector body 250 may be formed of materials such as plastics, polymers, bendable metals or composite materials that facilitate a semi-rigid, yet compliant outer surface 254. Further, the connector body 250 may be formed of conductive or non-conductive materials or a combination thereof. Manufacture of the connector body 250 may include casting, extruding, cutting, turning, drilling, knurling, injection molding, spraying, blow molding, component overmolding, combinations thereof, or other fabrication methods that may provide efficient production of the component.

Further embodiments of connector 200 may include a connector body member 90 formed of a conductive or non-conductive material. Such materials may include, but are not limited to conductive polymers, plastics, elastomeric mixtures, composite materials having conductive properties, soft metals, conductive rubber, rubber, and/or the like and/or any workable combination thereof. The connector body member 90 may comprise a substantially circinate torus or toroid structure, or other ring-like structure. For example, an embodiment of the connector body member 90 may be an O-ring disposed proximate the second end 252 of connector body 250 and the cavity 38 extending axially from the edge of first end 31 and partially defined and bounded by an outer internal wall 39 of coupling element 30 (see FIG. 4) such that the connector body O-ring 90 may make contact with and/or reside contiguous with the extended annular surface 256 of connector body 250 and outer internal wall 39 of coupling element 30 when operably attached to post 40 of connector 200. The connector body member 90 may facilitate an annular seal between the coupling element 30 and connector body 250 thereby providing a physical barrier to unwanted ingress of moisture and/or other environmental elements. Moreover, the connector body member 90 may facilitate further electrical coupling of the connector body 250 and coupling element 30 by extending therebetween an unbroken electrical circuit if connector body member 90 is conductive (i.e. formed of conductive materials). In addition, the connector body member 90 may further facilitate grounding of the connector 200, and attached coaxial cable 10 by extending the electrical connection between the connector body 250 and the coupling element 30. Furthermore, the connector body member 90 may effectuate a buffer preventing ingress of electromagnetic noise between the coupling element 30 and the connector body 250. It should be recognized by those skilled in the relevant art that the connector body member 90 may be manufactured by extruding, coating, molding, injecting, cutting, turning, elastomeric batch processing, vulcanizing, mixing, stamping, casting, and/or the like and/or any combination thereof in order to provide efficient production of the component.

Referring to FIGS. 1-9, a method of facilitating continuity through a coaxial cable connector 100 may include the steps of providing a post 40 having a first end 41, a second end 42, and a flange 45 proximate the second end 42, wherein the post 40 is configured to receive a center conductor 18 surrounded by a dielectric 16 of a coaxial cable 10, a connector body 50 attached to the post 40, and a coupling element 30 attached to the post 40, the coupling element 30 having a first end 31 and a second end 32, and disposing a biasing member 70 within a cavity 38 formed between the first end 31 of the coupling element 30 and the connector body 50 to bias the coupling element 30 against the post 40. Furthermore, a method of facilitating continuity through a coaxial cable connector 200 may include the steps of providing a post 40 having a first end 41, a second end 42, and a flange 45 proximate the second end 42, wherein the post 40 is configured to receive a center conductor 18 surrounded by a dielectric 16 of a coaxial cable 10, a coupling element 30 attached to the post 40, the coupling element 30 having a first end 31 and a second end 32, and a connector body 250 having a first end 251, a second end 252, and an annular surface 256 proximate the second end of the connector body, and extending the annular surface 256 a radial distance to engage the coupling element 30, wherein the engagement between the extended annular surface 256 and the coupling element 30 biases the coupling element 30 against the post 40.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A coaxial cable connector comprising:

a post having a first end, a second end, and a flange, wherein the post is configured to receive a center conductor surrounded by a dielectric of a coaxial cable;

a coupling element configured to engage the post and axially move between a first position, where the coupling element is partially tightened on an interface port, and a second position, where the coupling element is fully tightened on the interface port, the second position being axially spaced from the first position, the coupling element including an inward lip and a contact surface extending along a radial direction and facing a rearward direction; and a connector body configured to engage the post and the coaxial cable when the connector is in an assembled state, the connector body including:

an integral body biasing element having a contact portion extending from the body and toward a forward axial direction so as to contact the contact surface of the coupling element when the connector is in the assembled state; and a groove located axially rearward of the integral body biasing element and configured to allow the integral body biasing element to deflect along the axial direction;

wherein the integral body biasing element is configured to exert a biasing force against the contact surface of the coupling element sufficient to axially urge the inward lip of the coupling element towards the flange of the post when the coupling element axially moves between the first position, where the coupling element is partially tightened on the interface port, and the second position, where the coupling element is fully tightened on the interface port, and at least until the post contacts the interface port, so as to improve electrical grounding reliability between the coupling element and the post even when the coupling element is not fully tightened relative to the interface port; and wherein the integral body biasing element is made of a substantially non-metallic and non-conductive material and is configured to improve electrical grounding continuity between the coupling element and the post without a need for a metallic conductive continuity member that is subject to corrosion and permanent deformation during operable engagement and disengagement with an interface port.

2. The coaxial cable connector of claim 1, wherein the integral body biasing element is configured to exert a constant biasing force against the coupling element.

3. The coaxial cable connector of claim 1, wherein the integral body biasing element biases the internal lip of the coupling element against a surface of the flange of the post.

4. The coaxial cable connector of claim 1, wherein the integral body biasing element extends a radial distance from the body to engage the coupling element.

5. The coaxial cable connector of claim 1, wherein the integral body biasing element is resilient and is configured to flex axially into a void formed by the groove.

6. The coaxial cable connector of claim 1, wherein the post does not contact an interface port when the coupling element is in the first position, and the post does contact the interface port when the coupling element is in the second position.

7. The coaxial cable connector of claim 1, wherein the integral body biasing element is located so as to contact a rearmost portion of the coupling element, when the connector is in the assembled state.

8. The coaxial cable connector of claim 1, wherein the integral body biasing element resists degradation and rust.

9. The coaxial cable connector of claim 1, wherein the biasing force is exerted against the coupling element along the axial direction and toward a forward direction.

10. The coaxial cable connector of claim 9, wherein the integral body biasing element is configured to improve electrical grounding reliability between the coupling element and the post only when the biasing force is greater than a counter force exerted against the coupling element along the axial direction and toward a rearward direction opposite from the forward direction.

11. The connector of claim 1, wherein the biasing force is exerted against the connector body along the axial direction and toward a rearward direction.

12. The connector of claim 11, wherein the integral body biasing element is configured to improve electrical grounding reliability between the coupling element and the post only when the biasing force is greater than a counter force exerted against the connector body along the axial direction and toward a forward direction opposite from the rearward direction.

13. A coaxial cable connector for coupling an end of a coaxial cable and facilitating electrical connection with a coaxial cable interface port having a conductive surface, the coaxial cable having a center conductor surrounded by a dielectric, the dielectric being surrounded by a conductive grounding shield, the conductive grounding shield being surrounded by a protective outer jacket, the connector comprising:

a post having a first end, a second end, and a flange proximate the second end, wherein the post is configured to receive the center conductor and the dielectric of the coaxial cable;

a connector body having a first end and a second end, the first end configured to receive a prepared portion of the coaxial cable and the second end including an integral resilient biasing member proximate a notch on the connector body, wherein the integral resilient biasing member is configured to flex relative to a void formed by the notch when a force is exerted against it;

a coupling element rotatably attached to the post, the coupling element having a first end including a biasing contact surface and a second end configured to mate with an interface port, wherein the biasing contact surface is configured to contact and bias against the integral resilient biasing member of the connector body, when the connector is in an assembled state; and wherein the coupling element is configured to move between a first position, where the coupling element is partially tightened on the interface port, and a second position, where the coupling element is fully tightened on the interface port, the second position being axially spaced from the first position, wherein a biasing force is exerted between the integral resilient biasing member and the biasing surface of the coupling element when the coupling element axially moves between the first position and the second position, at least until the post contacts the interface port, so that during movement of the coupling element between the first and the second positions the coupling element persistently contacts the post and improves electrical grounding reliability between the coupling element and the post even when the coupling element is not fully tightened relative to the interface port.

14. The coaxial cable connector of claim 13, wherein the coupling element includes an internal lip.

15. The coaxial cable connector of claim 13, wherein the post does not contact the interface port when the coupling element is in the first position, and the post does contact the interface port when the coupling element is in the second position.

16. The coaxial cable connector of claim 13, wherein the integral resilient biasing member biases the internal lip of the coupling element against a surface of the flange of the post.

17. The connector of claim 13, wherein the integral resilient biasing member is configured to exert a constant biasing force against the coupling element.

18. The coaxial cable connector of claim 13, wherein the integral resilient biasing member resists degradation and rust.

19. The coaxial cable connector of claim 13, wherein the integral resilient biasing member extends a radial distance from the body to engage the coupling element.

20. The coaxial cable connector of claim 13, wherein the integral resilient biasing member extends an axial distance from the body to engage the coupling element.

21. The coaxial cable connector of claim 13, wherein the integral resilient biasing member is located to contact a portion of the coupling element that is axially closest to the connector body, when the connector is in the assembled state.

22. The coaxial cable connector of claim 13, wherein the post does not contact the interface port when the coupling element is in the first position, and the post does contact the interface port when the coupling element is in the second position.

23. A method of facilitating electrical continuity through a coaxial cable connector, the method comprising:

providing a coaxial cable connector including:

a post having a first end, a second end, and a flange, wherein the first end of the post is configured to receive a center conductor surrounded by a dielectric of a coaxial cable;

a connector body, having a first end, a second end, and a body contact surface, the first end configured to receive a portion of the coaxial cable and the second end including an integral resilient biasing member proximate a groove, wherein the integral resilient biasing member is configured to flex into a void formed by the groove when a force is exerted against it; and a coupling element rotatably attached to the post, the coupling element having a first end including a biasing contact surface and a second end configured to mate with an interface port, wherein the biasing contact surface is configured to contact and bias against the integral resilient biasing member of the connector body, when the connector is in an assembled state;

moving the coupling element between a first position, where the coupling element is partially tightened on the interface port, and a second position, where the coupling element is fully tightened on the interface port, the second position being axially spaced from the first position, wherein a biasing force is exerted between the integral resilient biasing member and the biasing surface of the coupling element when the coupling element axially moves between the first position and the second position, at least until the post contacts the interface port; and achieving an electrically conductive path through the coupling element and the post of the connector, when the coupling element is biased against the post by the integral resilient biasing member, even when the coupling element is only partially tightened onto the interface port.

24. The method of claim 23, wherein the coupling element includes an internal lip.

25. The method of claim 24, wherein the integral resilient biasing member biases the internal lip of the coupling element against a surface of the flange of the post.

26. The method of claim 23, wherein the integral resilient biasing member is configured to exert a constant biasing force against the coupling element.

27. The method of claim 23, wherein the integral resilient biasing member is made of a substantially non-metallic and non-conductive material.

28. The method of claim 27, wherein the integral resilient biasing member resists degradation and rust.

29. The method of claim 23, wherein the integral resilient biasing member extends a radial distance from the body to engage the coupling element.

30. The method of claim 23, wherein the integral resilient biasing member extends an axial distance from the body to engage the coupling element.

31. The method of claim 23, wherein the post does not contact the interface port when the coupling element is in the first position, and the post does contact the interface port when the coupling element is in the second position.

32. The method of claim 23, wherein the integral resilient biasing member is located to contact a portion of the coupling element that is axially closest to the connector body, when the connector is in the assembled state.

33. A coaxial cable connector for coupling an end of a coaxial cable and facilitating electrical connection with a coaxial cable interface port having a conductive surface, the coaxial cable having a center conductor surrounded by a dielectric, the dielectric being surrounded by a conductive grounding shield, the conductive grounding shield being surrounded by a protective outer jacket, the connector comprising:

a post having a first end, a second end, and a flange proximate the second end, wherein the post is configured to receive the center conductor and the dielectric of the coaxial cable;

a connector body having a first end and a second end, the first end configured to receive a prepared portion of the coaxial cable and the second end including an integral resilient biasing means proximate a void, wherein the integral resilient biasing means are configured to flex relative to the void when a force is exerted against the means;

a coupling means rotatably attached to the post, the coupling means having a first end including a biasing contact surface and a second end configured to mate with an interface port, wherein the biasing contact surface is configured to contact and bias against the integral resilient biasing means of the connector body, when the connector is in an assembled state; and wherein the coupling means are configured to move between a first position, where the coupling means are partially tightened on the interface port, and a second position, where the coupling means are fully tightened on the interface port, the second position being axially spaced from the first position, wherein a biasing force is exerted between the integral resilient biasing means and the biasing surface of the coupling means when the coupling means axially move between the first position and the second position, at least until the post contacts the interface port, so that during movement of the coupling means between the first and the second positions the coupling means persistently contacts the post and improves electrical grounding reliability between the coupling means and the post even when the coupling means are not fully tightened relative to the interface port.

34. The coaxial cable connector of claim 33, wherein the coupling means include an internal lip.

35. The coaxial cable connector of claim 33, wherein the post does not contact the interface port when the coupling means are in the first position, and the post does contact the interface port when the coupling means are in the second position.

36. The coaxial cable connector of claim 33, wherein the integral resilient biasing means bias the internal lip of the coupling means toward the flange of the post.

37. The coaxial cable connector of claim 33, wherein the integral resilient biasing means are configured to exert a constant biasing force against the coupling means.

38. The coaxial cable connector of claim 33, wherein the integral resilient biasing means resist degradation and rust.

39. The coaxial cable connector of claim 33, wherein the integral resilient biasing means extend a radial distance to engage the coupling means.

40. The coaxial cable connector of claim 33, wherein the integral resilient biasing means extend an axial distance from the body to engage the coupling element.

41. The coaxial cable connector of claim 33, wherein the integral resilient biasing means are located to contact a portion of the coupling means that is axially closest to the connector body, when the connector is in the assembled state.

42. A coaxial cable connector for coupling an end of a coaxial cable and facilitating electrical connection with a coaxial cable interface port having a conductive surface, the coaxial cable having a center conductor surrounded by a dielectric, the dielectric being surrounded by a conductive grounding shield, the conductive grounding shield being surrounded by a protective outer jacket, the connector comprising:

a post having a flange, wherein the post is configured to receive a center conductor surrounded by a dielectric of a coaxial cable;

a connector body, having a body contact surface, wherein the connector body is configured to receive a portion of the coaxial cable and is configured to be engaged with the post, when the connector is in an assembled state;

a nut configured to engage the post and axially move between a first position, where the nut is partially tightened on an interface port, and a second position, where the nut is fully tightened on the interface port, the second position being axially spaced from the first position, the nut having an internal lip, the internal lip having a lip contact surface facing a rearward direction, and an outer internal wall surface extending along an axial direction substantially perpendicular to the radial direction, the lip contact surface and the outer internal wall surface intersecting to form a corner of an orthogonal cavity between the nut and the connector body, when the connector is in the assembled state; and a biasing O-ring configured to fit within the cavity between the nut and the connector body, wherein the biasing O-ring has an axial dimension larger than the axial depth of the cavity between the body contact surface of the connector body and the internal lip of the nut, so as to be configured to exert a biasing force between the lip contact surface of the nut and the body contact surface of the body, the biasing force being sufficient to axially move the nut towards the flange of the post when the nut axially moves relative to the post between the first position, where the nut is partially tightened on the interface port, and the second position, where the nut is fully tightened on the interface port;

wherein the biasing force exerted by the biasing O-ring helps improve electrical grounding reliability between the nut, the post, and the interface port, even when the nut is not fully tightened relative to the interface port; and wherein the biasing O-ring is also configured to provide a physical seal between the nut and the connector body when the connector is in the assembled state; and further wherein the biasing O-ring is made of substantially non-metallic and non-conductive material.

43. The coaxial cable connector of claim 42, wherein the biasing O-ring biases the internal lip of the nut against a surface of the flange of the post.

44. The coaxial cable connector of claim 42, wherein the biasing O-ring is configured to exert a constant biasing force against the nut.

45. The coaxial cable connector of claim 42, wherein the biasing O-ring is resilient and is configured to exert a constant biasing force against the nut when the connector is in the assembled state and when the nut moves between the partially tightened position and the fully tightened position.

46. The coaxial cable connector of claim 42, wherein the biasing O-ring resists degradation and rust.

47. The connector of claim 42, wherein the biasing force is exerted against the nut along the axial direction and toward a forward direction.

48. The connector of claim 47, wherein the biasing O-ring is configured to improve electrical grounding reliability between the nut and the post only when the biasing force is greater than a counter force exerted against the nut along the axial direction and toward a rearward direction opposite from the forward direction.

49. The connector of claim 42, wherein the biasing force is exerted against the connector body along the axial direction and toward a rearward direction.

50. The connector of claim 49, wherein the biasing O-ring is configured to improve electrical grounding reliability between the nut and the post only when the biasing force is greater than a counter force exerted against the connector body along the axial direction and toward a forward direction opposite from the rearward direction.

* * * * *